US010577057B1

(12) United States Patent
Hull

(10) Patent No.: US 10,577,057 B1
(45) Date of Patent: Mar. 3, 2020

(54) MODULAR WATERCRAFT PLATFORM

(71) Applicant: Alan Hull, Wellington, FL (US)

(72) Inventor: Alan Hull, Wellington, FL (US)

( * ) Notice: Subject to any disclaimer, the term of this patent is extended or adjusted under 35 U.S.C. 154(b) by 0 days.

(21) Appl. No.: 16/521,513

(22) Filed: Jul. 24, 2019

Related U.S. Application Data

(60) Provisional application No. 62/730,148, filed on Sep. 12, 2018.

(51) Int. Cl.

| | |
|---|---|
| ***B63B 25/18*** | (2006.01) |
| ***B63B 25/00*** | (2006.01) |
| ***B63B 35/73*** | (2006.01) |
| ***B63B 35/85*** | (2006.01) |

(52) U.S. Cl.
CPC ..... *B63B 25/18* (2013.01); *B63B 25/002* (2013.01); *B63B 35/85* (2013.01); *B63B 35/731* (2013.01)

(58) Field of Classification Search
CPC ..... B63B 17/00; B63B 25/00; B63B 25/002; B63B 35/00; B63B 35/73
USPC ..... 114/55.55, 55.57, 343, 364
See application file for complete search history.

(56) References Cited

U.S. PATENT DOCUMENTS

| | | | | |
|---|---|---|---|---|
| 7,124,704 | B1 * | 10/2006 | Strom | B63B 17/00 114/364 |
| 7,886,677 | B2 * | 2/2011 | Strom | B63B 25/002 114/364 |
| 8,833,289 | B2 * | 9/2014 | Isaac | B63B 17/00 114/364 |
| 2007/0000426 | A1 * | 1/2007 | Strom | B63B 17/00 114/364 |
| 2014/0144365 | A1 * | 5/2014 | Isaac | B63B 25/00 114/343 |

* cited by examiner

*Primary Examiner* — Lars A Olson
(74) *Attorney, Agent, or Firm* — Johan Eide; Christopher Pilling; My Patent Guys

(57) ABSTRACT

The present invention includes a modular and removable watercraft platform for providing storage, stability, and mounting means to a user of a PWC. The modular watercraft platform of the present invention is directly for use in fresh and salt water and use with multiples sizes, brands, and types of PWC through multiple adjustment members. The modular watercraft platform allows the user to convert a stock factory PWC to include a front support assembly and a rear platform assembly. The modular watercraft platform allowing for storage, transport, and mounting of various items and accessories, as well as facilitating recreational activities upon the front support assembly and/or the rear assembly.

18 Claims, 16 Drawing Sheets

MODULAR WATERCRAFT PLATFORM

RELATED APPLICATION

This application claims priority to provisional patent application U.S. Ser. No. 62/730,148 filed on Sep. 12, 2018, the entire contents of which are herein incorporated by reference.

BACKGROUND

1. Field of the Invention

The present invention relates to a modular watercraft platform for enabling human recreational activity and storage upon a watercraft.

2. Description of Related Art

A personal watercraft or herein defined as a "PWC", also called a water scooter or a JET SKI™, is an exemplary recreational watercraft wherein a user typically sits or stands upon the watercraft, rather than inside of. Currently, it is difficult for many recreational activities to take place upon most PWC's. Furthermore, items to be stored upon, animals to be transported, and accessories to be mounted upon PWC's are often desired by the user of a PWC. For example, it is very difficult to fish or hunt from a PWC with stability or to store the necessary gear for fishing or hunting upon a PWC. Typically, the hull of most PWC's have a pointed or rounded front section and a semi-square rear end, wherein the pointed or rounded section easily parts water as the user navigates open water. The semi-square rear end or the sides of the PWC are most desirable for the user to engage in recreational activities from because the user is able to position their body closest to the sides or the semi-square rear end of the PWC. A solution is needed for comfortably providing the user stability around the sides and the semi-square rear end of PWC.

Semi-permanent or invasive mounting means exist in the marketplace for mounting accessories such as fish-finders or fishing rod holders to PWC's, but often require extensive mounting hardware and that damages the hull of the PWC during assembly. Additionally, many permanent, semi-permanent or invasive mounting means exist only configured to match products and PWC's designed by commercial manufacturers of PWC's. Other mountings means are only configured for specific types of PWC's. A solution is needed for a system that universally attaches, mounts or rests upon multiple brands or types of PWC's without damaging or permanently altering the hull or the body of the PWC.

SUMMARY

The present invention includes a modular and removable watercraft platform for providing storage, stability and mounting means to the operator of a watercraft. The modular watercraft platform of the present invention is directed for use in fresh water and salt water. The modular watercraft platform is configured to use with multiple sizes, brands, and types of PWC through multiple adjustment members strategically placed at key locations along elements of the modular watercraft platform. The modular watercraft platform allows the user to convert a stock factory PWC to include a front support assembly and a rear platform assembly. The modular watercraft platform allowing for storage, transport, and mounting of various items and accessories, as well as facilitating recreational activities upon the front support assembly and/or the rear platform assembly.

One object of the present invention is to provide non-invasive mounting means for the modular watercraft platform. For example, the modular watercraft platform does not require additional fasteners or mounting means that are damaging to the body or hull of the PWC.

Another object of the present invention is to provide a platform that is removable, easy to assemble and disassemble with or without the use of tools.

Another object of the present invention is to provide a lightweight platform that is easily adapted and lifted from the PWC by a single user, while still maintaining high structural integrity during operation.

Another object of the present invention is to provide mounting means for at least one accessory of an accessory set to the modular watercraft platform in substitution of mounting the at least one accessory to the body or the hull of the PWC permanently. Exemplary accessories include batteries, trolling motors, fish-finders or flotations devices.

Another object of the modular watercraft platform is to provide the front support assembly and the rear platform assembly independently as needed by the user. For example, the front support assembly can be used with or without the rear platform assembly.

Another object of the present invention is to provide containment of objects, animals, and humans upon the watercraft during operation by means of at least one barrier and variable external textures. The at least one barrier is optionally adjoined to the rear platform assembly and among other uses, can aid in keeping an object, animal or human upon the PWC.

In order to do so, a modular watercraft platform is provided having a front support assembly, the front support assembly comprising of at least two frame members on each side of a seat of the watercraft. At least one cross-member is adjoined to the at least two frame members and at least two-foot decks adjoined to the at least two frame members. The at least two-foot decks allowing the operator stability during operation of a watercraft. In some embodiments, a rear platform assembly is joined to the front support assembly. The rear platform assembly, including a deck frame, having a top surface and a bottom surface and a rear deck, joined to the top surface of the deck frame.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF CERTAIN EMBODIMENTS

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

As used in this application, the term "a" or "an" means "at least one" or "one or more."

Figure 1:
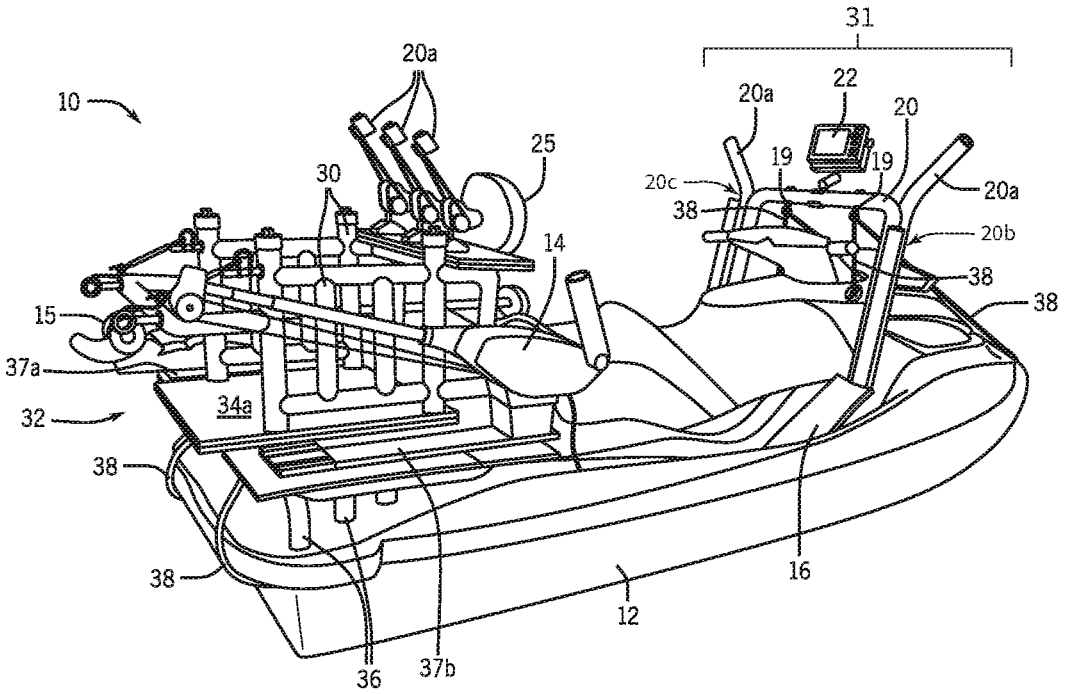
FIG. 1 shows an exemplary perspective view of one embodiment of the modular watercraft platform mounted upon an exemplary personal watercraft.

FIG. 1 illustrates a modular watercraft platform 10 for mounting to a watercraft 12. The modular watercraft platform 10 comprises a front support assembly 31. In the present embodiment, as illustrated, the front support assembly 31 includes at least two frame members embodied as a right frame member 20*b* and a left frame member 20*c*. The at least two frame members form structural integrity on the sides of the front support assembly 31. In other embodiments, the modular watercraft platform 10 comprises at least one frame member. In some configurations, the front support assembly 31 may be used independently from other components of the modular watercraft platform 10.

In some embodiments, the left frame member 20*c* and the right frame member 20*b* may be arranged on each side of a seat of the watercraft 12. The right frame member 20*b* and the left frame member 20*c* having a proximal end and a distal end. In the exemplary embodiment, the proximal end of the at least two frame members are oriented towards a front end of the watercraft 12 and the distal end is oriented towards a rear end of the watercraft 12. The at least two frame members are configured to generally match a body of the watercraft 12 within a footwell 126 of the watercraft 12 or any portion of the watercraft 12 that a human would stand upon during normal operation. Connecting the at least two frame members is a cross-member 20. The cross-member 20 forms structural integrity between the at least two frame members laterally. In some embodiments, the modular watercraft platform 10 comprises at least one cross-member 20. The present embodiment, as shown in FIG. 1, the cross-member 20 is adjoined to and connects the right frame member 20*b* to the left frame member 20*c*. In some embodiments, the at least two frame members having at least two-foot decks, respectively adjoin to each of the at least two frame members. In the present exemplary embodiment, arranged upon the at the left frame member 20*c* and the right frame member 20*b*, is a left foot deck 18*a* and a right foot deck 16*a*, respectively. The left foot deck 18*a* and the right foot deck 16*a* serving as a stable surface for the operator of the watercraft 12 to use during, and outside of, normal operation. In some embodiments, the left foot deck 18*a* and the right foot deck 16*a* each have a right foot deck support 16*b* and a left foot deck support 18*b*, respectively. The right foot deck support 18*b* and the left foot deck support 16*b* aiding to support and give rigidity to the left foot deck 18*a* and the right foot deck 16*a*.

Figure 2A:
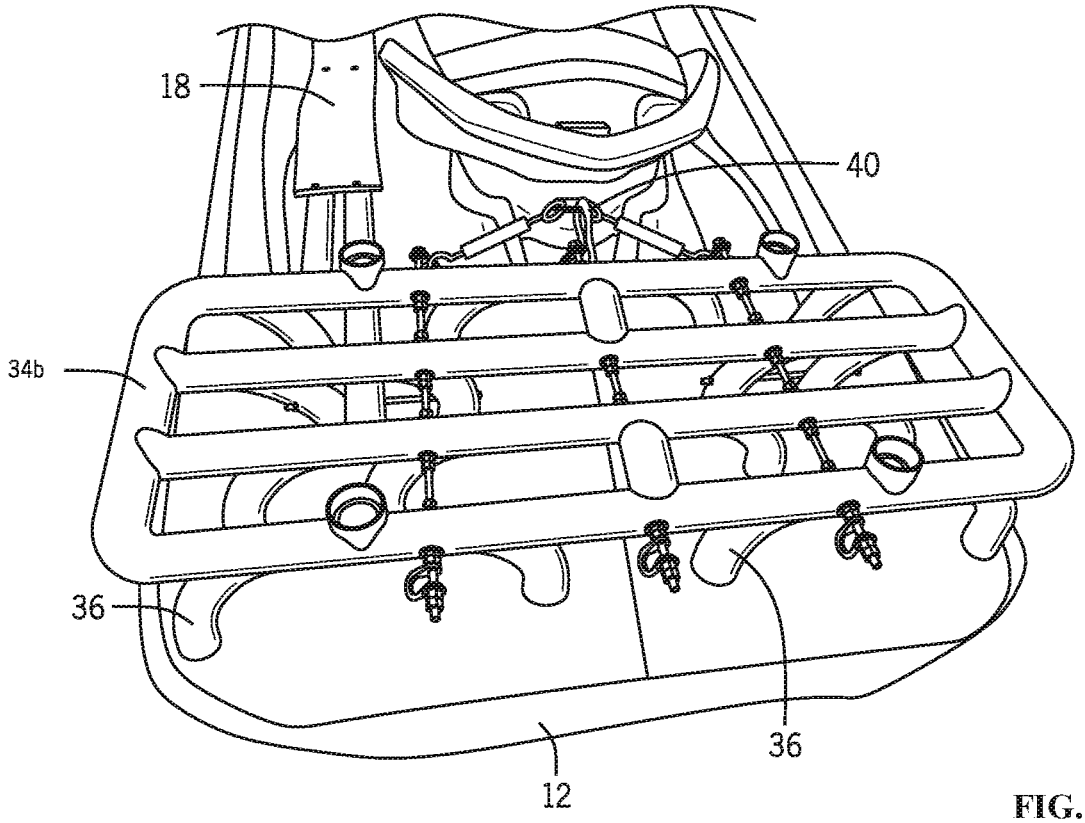
FIG. 2A shows an exemplary perspective view of one embodiment of the rear platform assembly of the modular watercraft platform mounted upon an exemplary personal watercraft.

As shown in FIG. 2A, in some embodiments the modular watercraft platform 10 further comprises a rear platform assembly 32 joined to the front support assembly 31. The rear platform assembly 32 may be used independently from other components of the modular watercraft platform 10. In an exemplary use, the rear platform assembly 32 can be used for various recreational activities including fishing, scuba diving, hunting, search and rescue operations, or jet ski fishing rentals. The adjoining of the front support assembly 31 to the rear platform assembly 32, in the present embodiment, is facilitated by an articulating joint 125. In other embodiments, the adjoining of the front support assembly 31 to the rear platform assembly 32 is facilitated by a hinged connection, a temporary connection or a permanent connection. The rear platform assembly 32 further includes a deck frame 34*b* and a rear deck 34*a*. The deck frame 34*b* having a top surface and a bottom surface, wherein the bottom surface is in close proximity to the body of the watercraft 12. Resting upon and/or joined to the top surface of the deck frame 34*b* is the rear deck 34*a*.

Figure 2B:
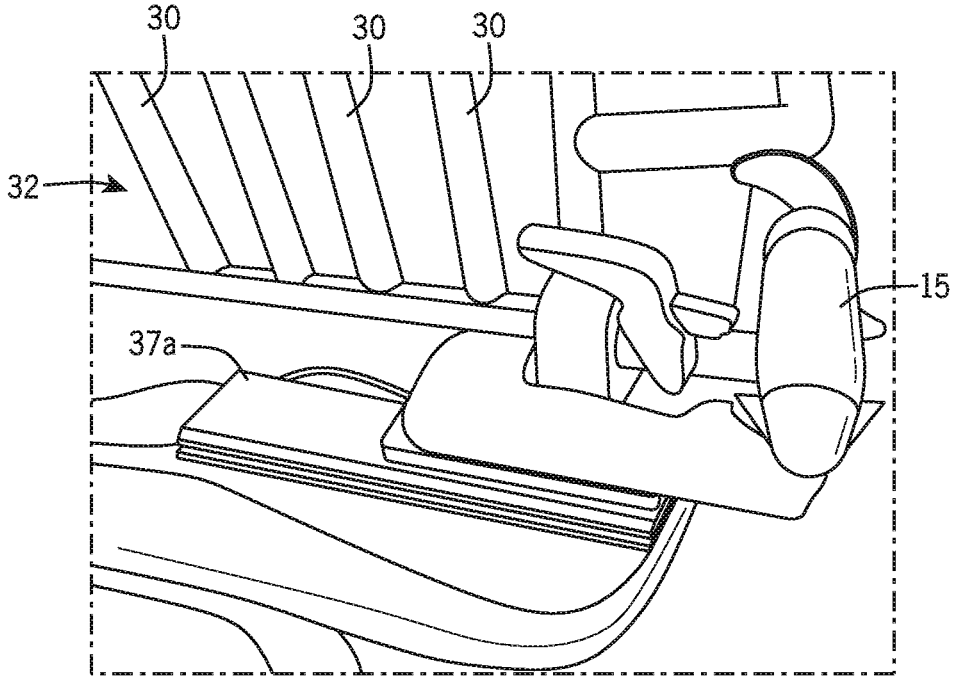
FIG. 2B shows an exemplary perspective view of one embodiment of the trolling motor mount of the modular watercraft platform.

FIG. 2B, as well as FIG. 1, illustrates the rear deck 34*a* of the rear platform assembly 32 having a left accessory mount 37*a* for the user with a trolling motor 15. FIG. 1 additionally illustrates an embodiment wherein the rear deck 34*a* further comprises a right accessory mount 37*b* housing a downrigger 14 on the right side of the rear platform assembly 32 of the modular watercraft platform 10. The exemplary embodiment, as shown in FIGS. 1 and 2B, has the trolling motor 15 mount and the downrigger 14 mount positioned such that during normal operation and deployment a portion of a trolling motor 15 or a downrigger 14 is offset from the rear deck 34*a*, allowing for proper use. In other embodiments, the rear platform assembly 32 can be modified to exclude the trolling motor 15 mount and/or the downrigger mount 37*a* to allow for additional carrying capacity upon the rear deck 34*a*.

In other embodiments, the trolling motor mount 37*b* and/or the downrigger mount 37*a* may be replaced with at least one member of an accessory set consisting of: a downrigger 14 mount, a cup holder 21, a fishing rod mount, a cushion, a hook, a gas tank mount, an air tank mount, a floatation device mount, an anchor mount, a cooler mount, a foldable cooler mount, a live well mount, a battery mount, a clip, a detachable seat, a table, a trolling motor 15 mount, an outboard mount, a shallow water anchor mount, a camera mount, a grill mount, a flag mount, a navigation light, a digital processing device mount 22, a gun mount, a fish-finder mount, a radar mount, a sonar mount, and a chart plotter mount. The digital processing device mount 22, as discussed above, may include, by way of non-limiting examples, server computers, desktop computers, laptop computers, notebook computers, sub-notebook computers, netbook computers, net-pad computers, set-top computers, media streaming devices, handheld computers, Internet appliances, mobile smartphones, tablet computers, personal digital assistants, video game consoles, and vehicles. In some embodiments, the right frame member 20*b* and the left frame member 20*c* is designed to further include a left rod holder 20*d* and a right rod holder 20*e*.

In some embodiments wherein the front support assembly, 31 is used independently from any other component of the modular watercraft platform 10, the left frame member 20*c* and the right frame member 20*b* may further comprise a front locking member (not shown). The front locking member aiding in securing the front support assembly 31 to the watercraft 12 when the rear platform assembly 32 is not present in the current configuration of the modular watercraft platform 10. The front locking member may be connected permanently or temporarily to the front support assembly 31 and the watercraft 12. The front locking member may comprise, by way of non-limiting example, at least one member of a front locking member set consisting of: a turnbuckle, a hook, a fastener, a threaded rod, a strap, a ratcheting member, a u-joint, a carabiner, a rope, a chain, a rigid member or any combination thereof. For example, in exemplary use, the left frame member 20*c* and the right frame member 20*b* may be adjoined with at least one front locking member, such as a ratcheting member, and another front locking member may secure the front support assembly 31 in a desired location on top of the watercraft 12.

Figure 3:
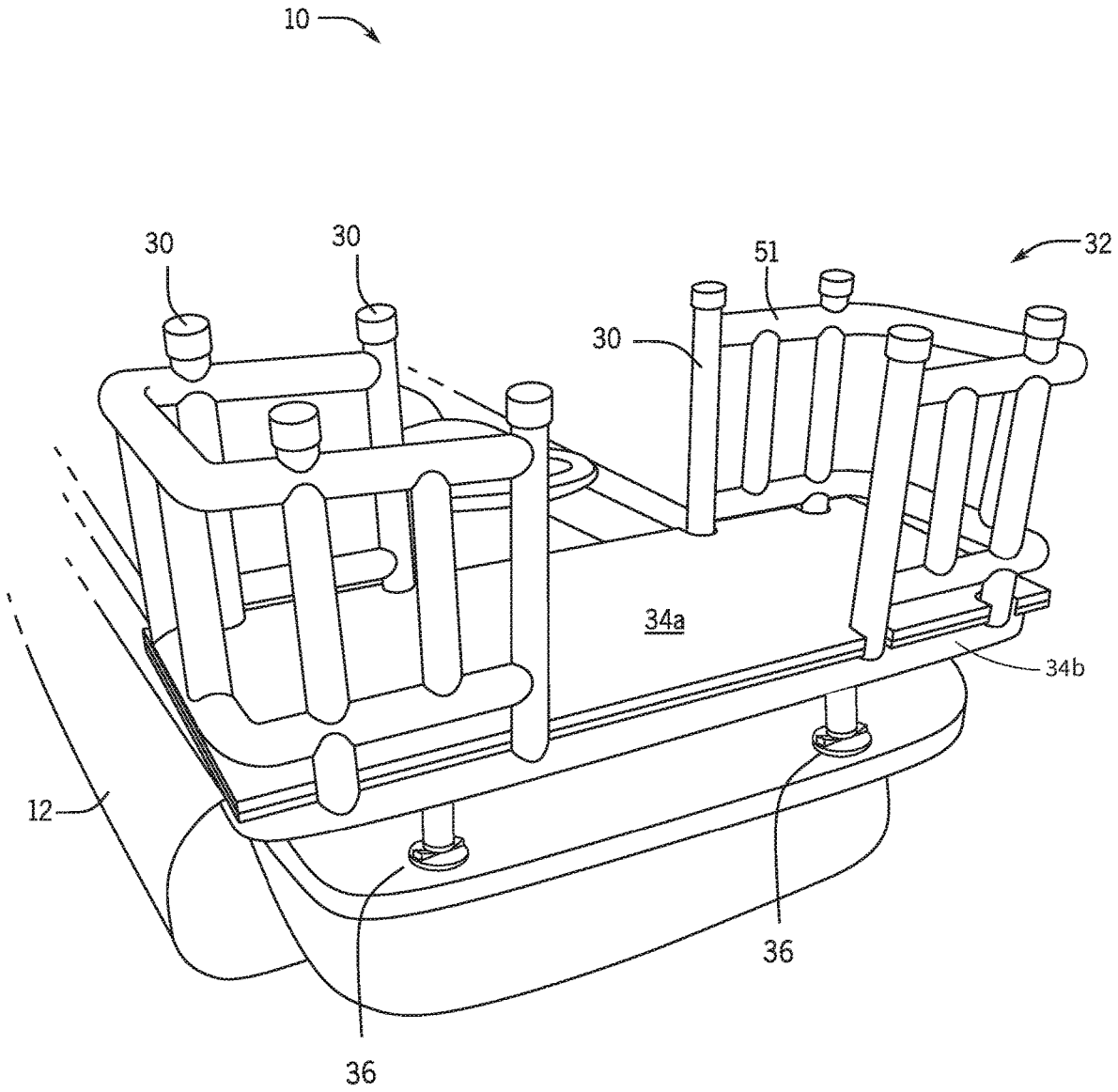
FIG. 3 shows an exemplary perspective view of one embodiment of the modular watercraft platform mounted upon an exemplary personal watercraft.
Figure 4:
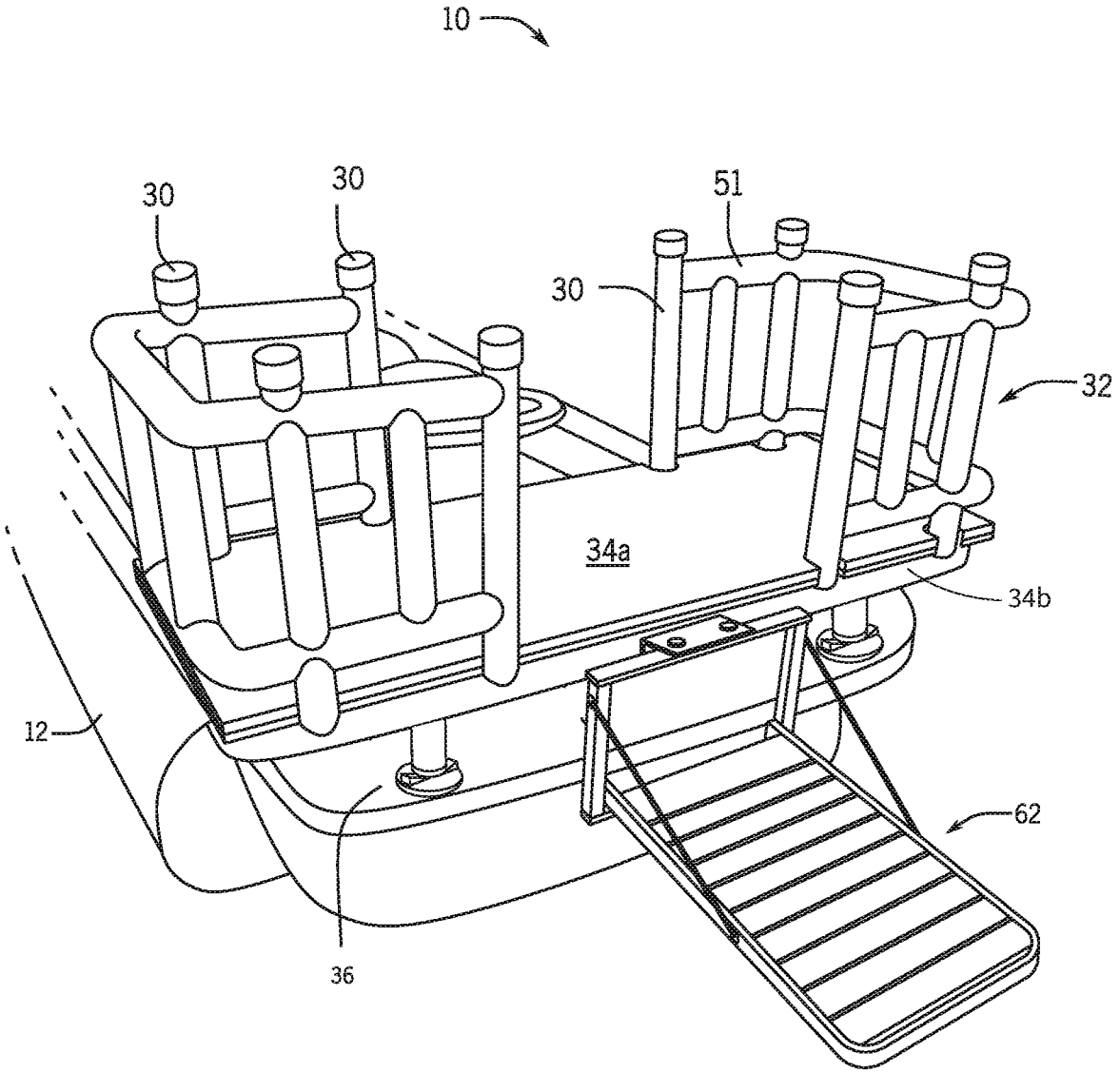
FIG. 4 shows an exemplary perspective view of one embodiment of the modular watercraft platform mounted upon an exemplary personal watercraft.
Figure 5:
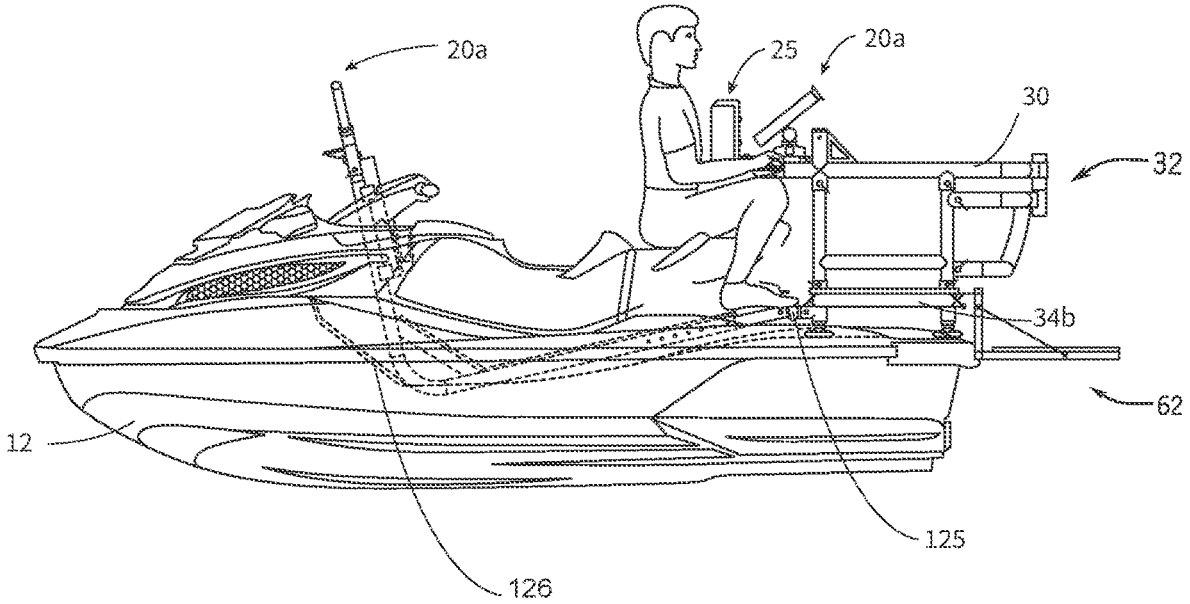
FIG. 5 shows an exemplary left view of one embodiment of the modular watercraft platform mounted upon an exemplary personal watercraft.
Figure 6:
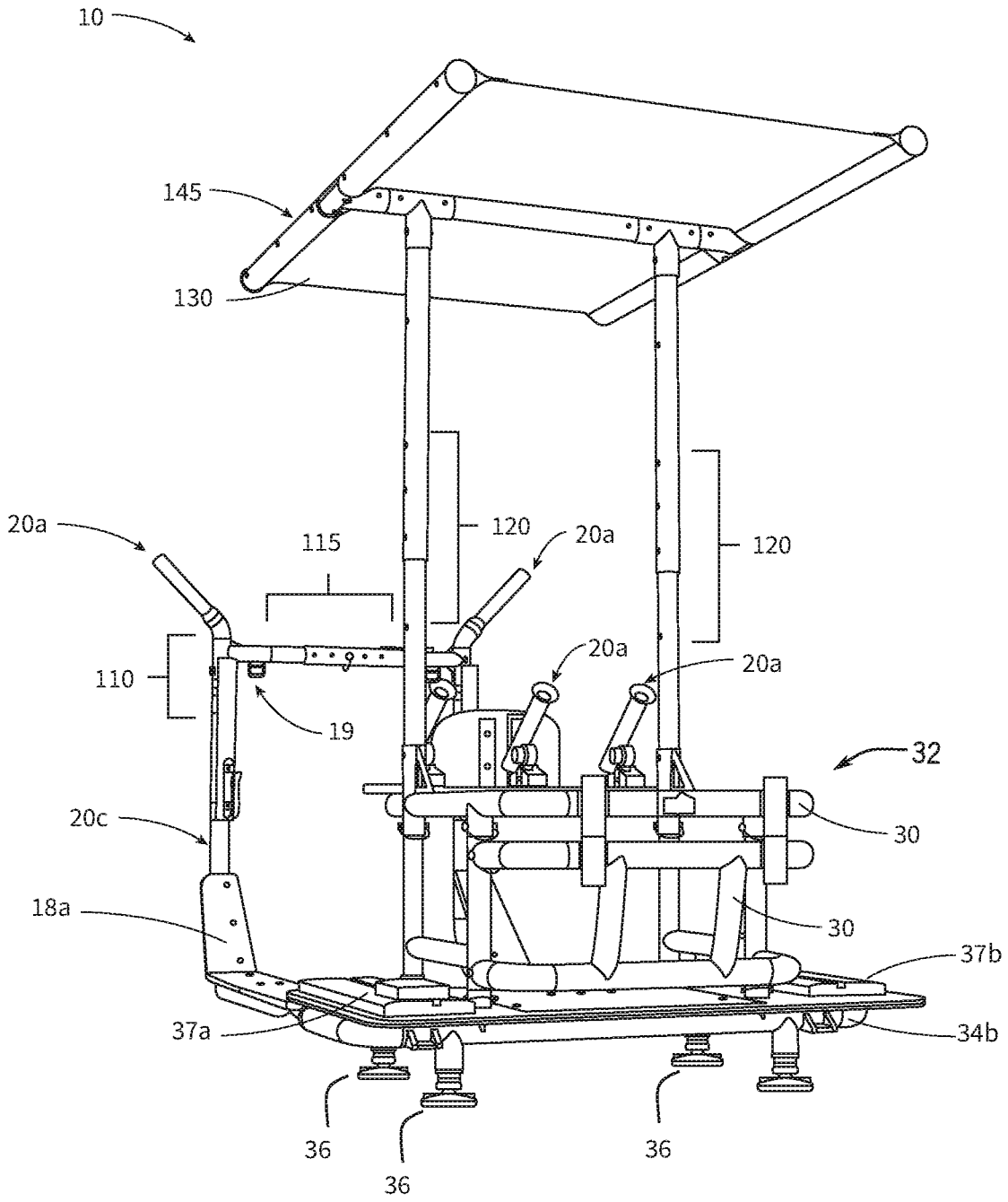
FIG. 6 shows an exemplary perspective view of one embodiment of the modular watercraft platform.
Figure 7:
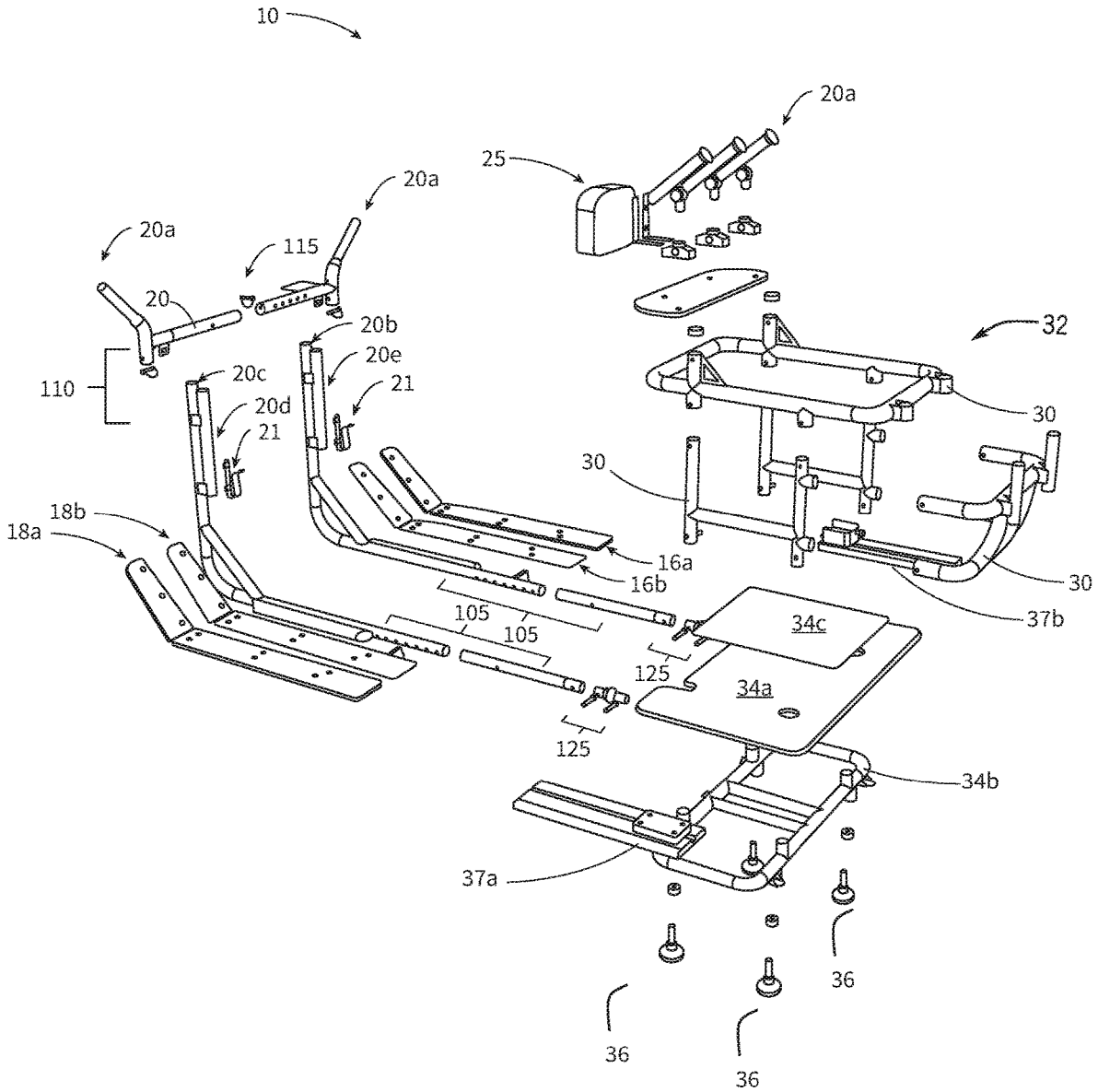
FIG. 7 shows an exemplary exploded view of one embodiment of the modular watercraft platform.
Figure 8:
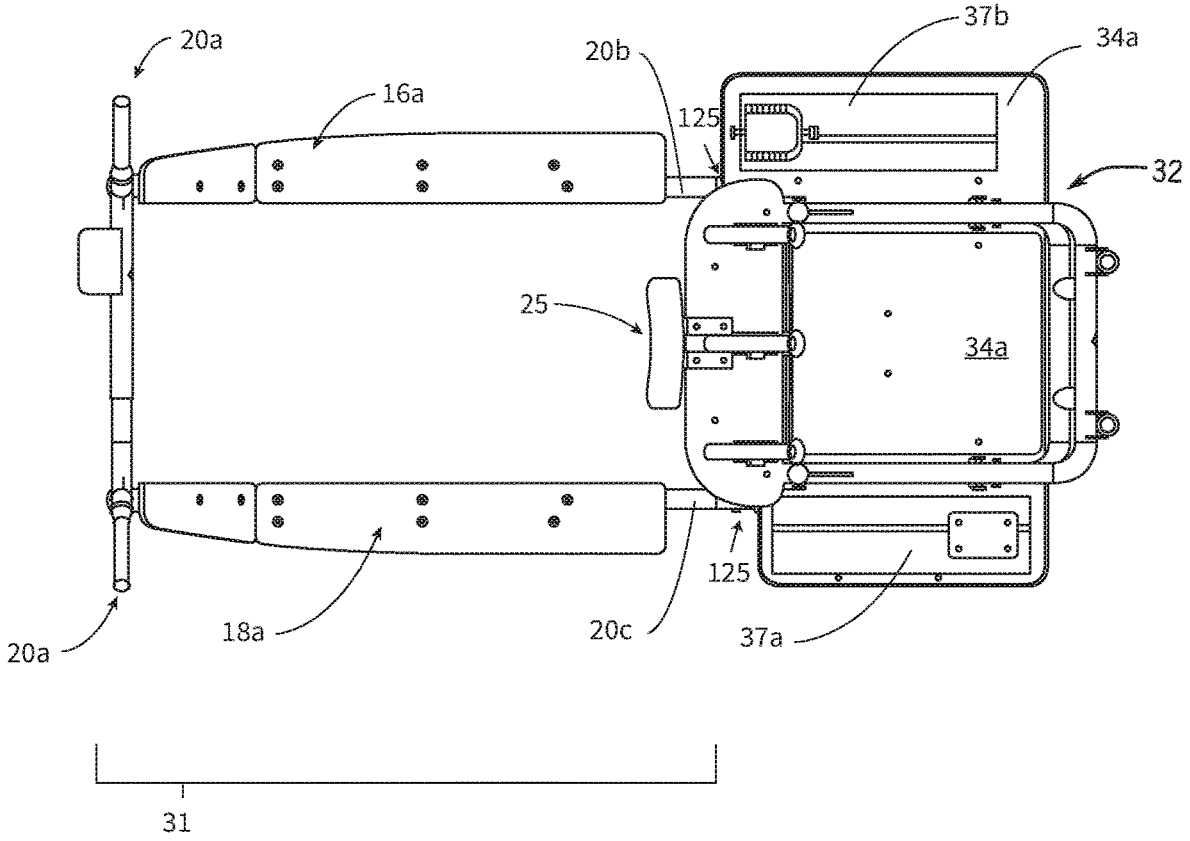
FIG. 8 shows an exemplary top view of one embodiment of the modular watercraft platform.
Figure 9:
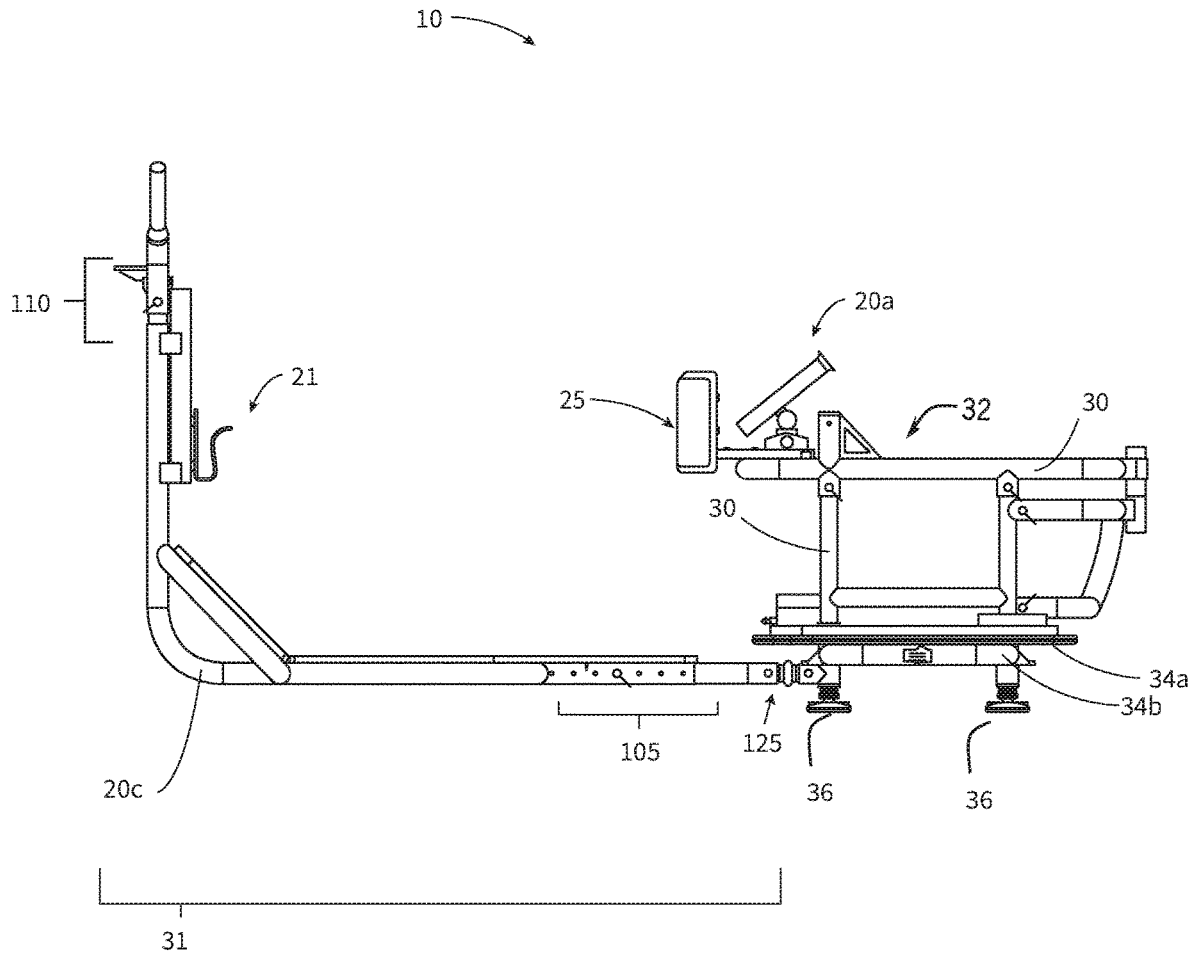
FIG. 9 shows an exemplary left view of one embodiment of the modular watercraft platform.
Figure 10:
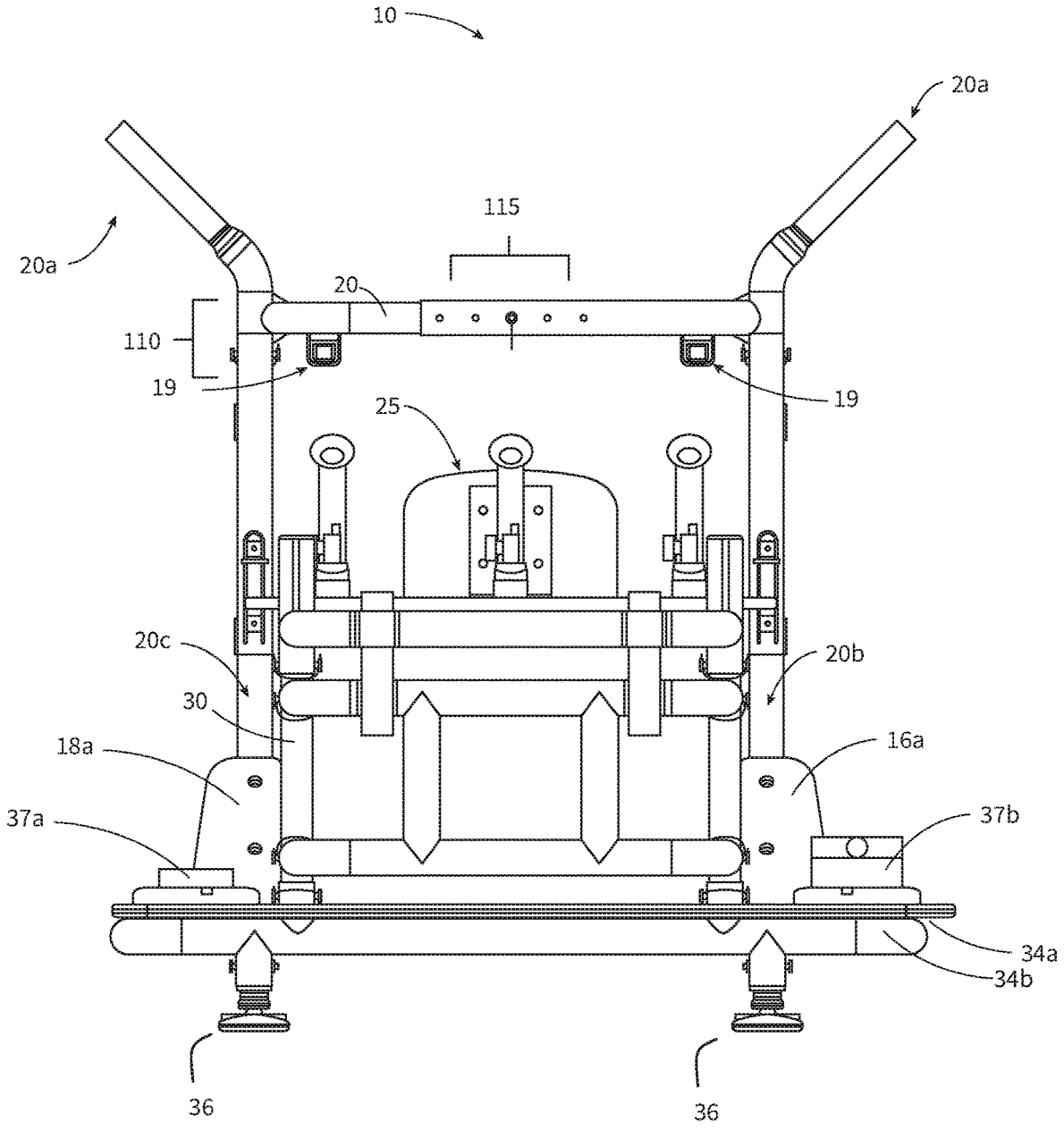
FIG. 10 shows an exemplary rear view of one embodiment of the modular watercraft platform.

As illustrated in FIG. 3 and FIG. 4, the rear platform assembly 32 may further comprise a barrier member 30. In some embodiments, the barrier member 30 is adjoined to the deck frame 34*b* or the rear deck 34*a* of the rear platform assembly 32 permanently or temporarily. In other embodiments, the rear platform assembly 32 may comprise at least one unit of the barrier member 30. The barrier member 30 aiding in retaining cargo, animals and/or humans upon the rear deck 34*a* during recreational use or normal operation of the watercraft 12. The barrier member 30 may be configured as a solid wall, any form of rigid structure, or any tubular configuration. In an exemplary configuration having a tubular configuration, a barrier member 30 may be adjoined to the rear platform assembly 32, the watercraft 12 or another unit of the barrier member 30. For example, the at least one barrier member 30 can be modified in width and height to allow for larger carrying capacity of an object or an animal, such as a hunting dog, upon the rear deck 34*a*. Temporary or permanent connections to adjoin any elements of the modular watercraft platform, as discussed above, may consist of nested tubular mating wherein a spring pin, a collar pin, a clamp, a spring, a press-fit, a bayonet connection, a weld or any other joining means known to one skilled in the art. Depending upon the size of the human, the recreational activity of the user, the operation of the watercraft 12, the animal or the object held upon, the barrier member 30 of the rear platform assembly 32 may be configured, in some embodiments, to expand or collapse to substantially match the size of the human, the animal, the recreational activity of the user, the operation of the watercraft 12 or the object. In some embodiments, the at least one barrier member 30 may further comprise a rigid or non-rigid gate, allowing access on and off the rear platform assembly 32 and/or the watercraft 12.

As shown in FIGS. 5-10, the modular watercraft platform 10 is designed to configure and generally match all sizes of the watercraft 12. For example, the present invention may be modular in that the modular watercraft platform 10 can adapt to multiple types and/or sizes of the watercraft 12 including, by way of non-limiting example, a kayak, a JET SKI™, a paddleboard, or a boat. During assembly the front support assembly 31 may need to be re-sized, extending or contracted to properly match the body of the watercraft 12. In the exemplary embodiments shown, the distal end of the at least two frame members each further comprise a first adjustment member 105 having a series of predetermined adjustment stages allowing for variable linear adjustment to a length of the distal end. For example, the distal end of the at least two frame members in a tubular configuration may be designed to rest within the deck frame 34*b* also having a tubular configuration of differing diameter. In further detail, the distal end of the at least two frame members may include at least one protrusion, at least one indentation, at least one aperture or at least one spring member aiding the user in incrementally adjusting the length of the distal end of the at least two frame members. For example, the distal end of the at least two frame members may comprise a series of equally spaced apertures that are configured to receive a spring-loaded protrusion adjoined to the deck frame 34*b* member. One skilled in the art will recognize that other joining methods and means may be utilized to join the at least two frame members to the rear platform assembly 32 or any other elements for the modular platform assembly.

Clear sight by the operator of the watercraft 12 is critical to the proper and safe operation of the watercraft 12. In some embodiments, the proximal end of the at least two frame members can each further comprise a second adjustment member 110. The second adjustment member 110 assisting the user in configuring the modular watercraft platform 10 to substantially match the body of the watercraft 12 The second adjustment member 110 having a series of predetermined adjustment stages allowing for variable linear adjustment to a length of the proximal end of the at least two frame members. In doing so the height of the cross-member 20 in relation to the body of the watercraft 12 may be adjusted as desired. In other embodiments, the height of the cross-bar is fixed in relation to the body of the watercraft 12, regardless of linear adjustment of the second adjustment member 110. The proximal end of the at least two frame members may be hollow or designed to have a cross-sectional area that is specifically adapted for a specific recreational function. For example, the proximal end of the at least two frame members may be configured to receive at least one member of the accessory set, such as a fishing pole or a downrigger 14. In some embodiments, the proximal end of the at least two frame members are angled to aid in opening the sight path of the operator or for proper use of recreational equipment adjoined to the modular watercraft platform 10. In embodiments wherein the proximal end of the at least two frame members are angled, the proximal end may further comprise a rod holder 20*a* wherein the rod holder 20*a* is configured to retain at least one member of the accessory set, such as a fishing rod or an outrigger during use.

In some embodiments, the cross-member 20 further comprises a third adjustment member 115 having a series of predetermined adjustment stages allowing for variable linear adjustment to a length of the cross-member 20. The cross-member 20 may include, similar to the at least two frame members, at least one protrusion, at least one indentation, at least one aperture, or at least one spring member aiding the user in incrementally adjusting the length of the cross-member 20. For example, in exemplary use, the operator may need to adjust the length of the cross-member 20 to match the width of a watercraft 12 seat.

Figure 11:
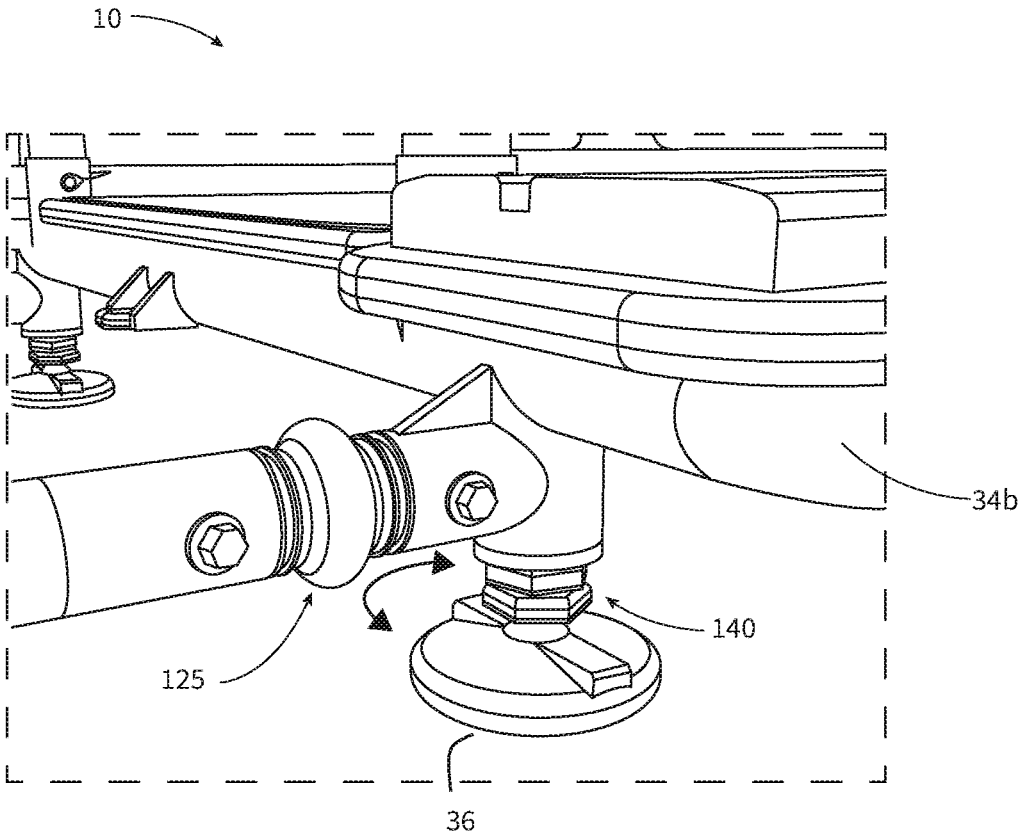
FIG. 11 shows an exemplary perspective view of one embodiment of an articulating joint and vertical support of the modular watercraft platform.

As shown in FIG. 11, the modular watercraft platform 10 may include at least one of the vertical support 36 adjoined to the bottom surface of the deck frame 34*b*, wherein the at least one vertical support 36 serves to elevate the deck 16*a* above the body of the watercraft 12. Variable adjustment by the operator of the vertical adjustment member 140 of the at least one vertical support 36 allows for proper alignment of the rear platform assembly 32 to different watercraft 12 or to account for variances in height of the body of the watercraft 12.

As shown in FIGS. 12 and 14-16, the modular watercraft platform 10 may include a canopy 130. In other embodiments, the modular watercraft platform may include one or more units of the canopy 130. The canopy 130 having a canopy frame 145 joined to and extending above the rear platform assembly 32 and/or the front support assembly 31. In some embodiments, the canopy 130 having at least one canopy attachment to adjoin one unit of the canopy 130 to another unit of the canopy 130, to adjoin the canopy 130 to the canopy frame 145 or any other component of the modular watercraft platform 10. By way of the non-limiting example, the at least one canopy attachment may comprise zippers, snaps, buttons, tape, hook-and-loop fastener, hooks, laces, adhesive, or magnets. In some embodiments, the canopy frame 145 may further comprise any member of the accessory set. For example, the canopy 130 may secure an antenna, a light or a location beacon for optimate visibility or reception.

Figure 12:
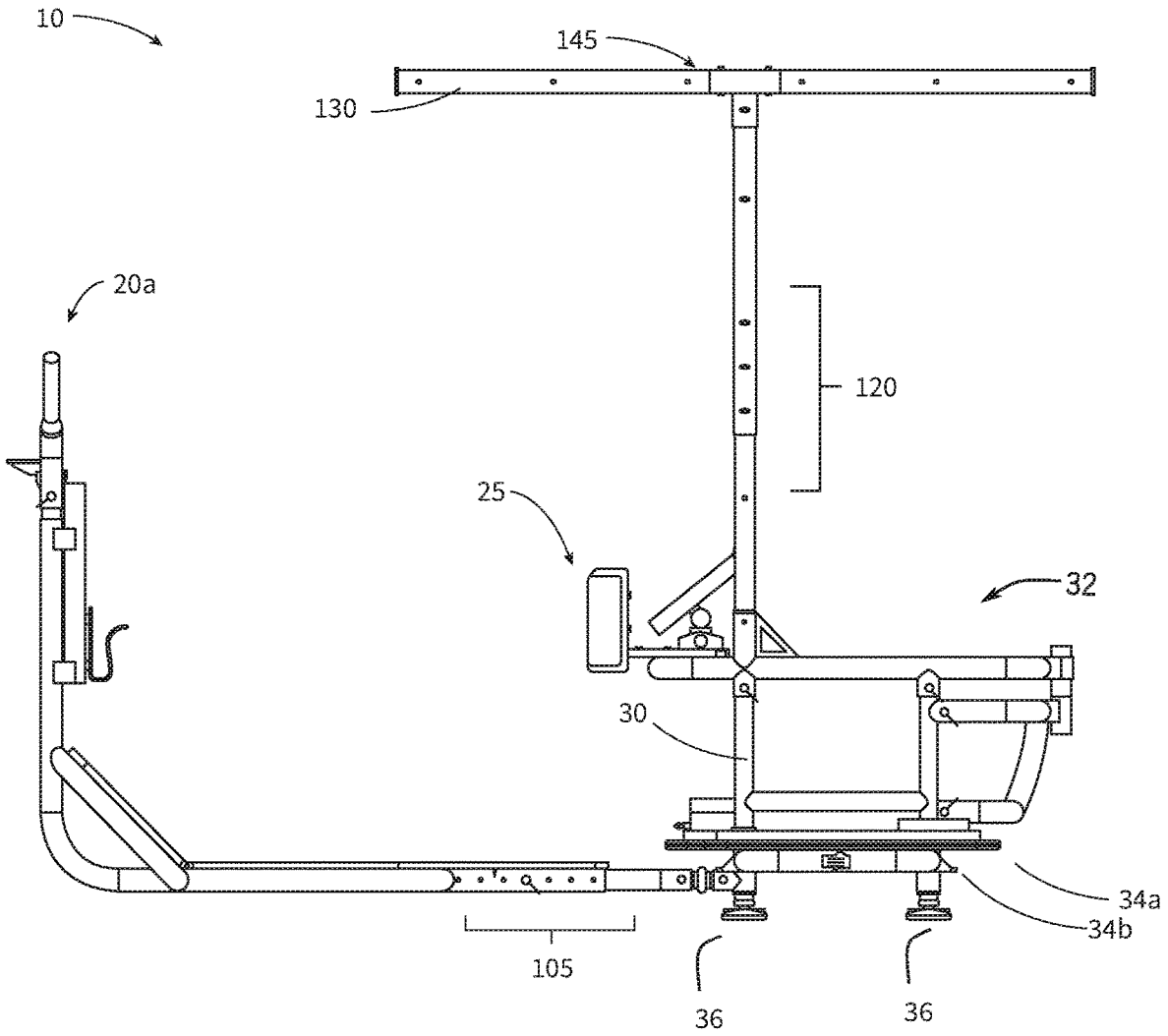
FIG. 12 shows an exemplary left view of one embodiment of the modular watercraft platform.
Figure 13:
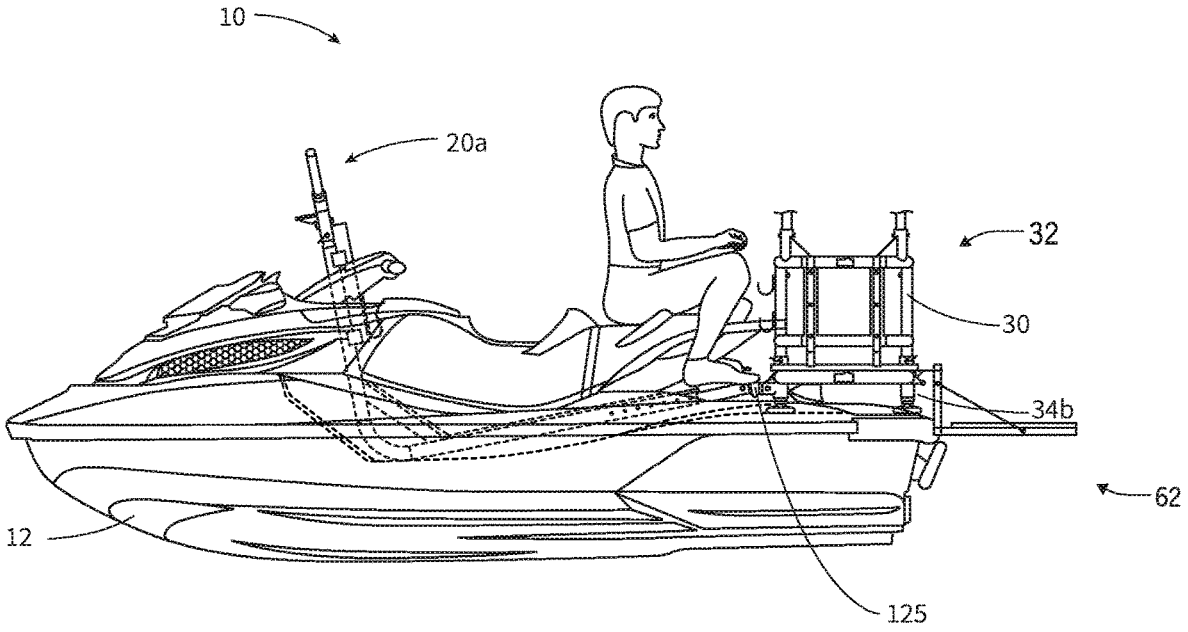
FIG. 13 shows an exemplary left view of one embodiment of the modular watercraft platform mounted upon an exemplary personal watercraft.
Figure 14:
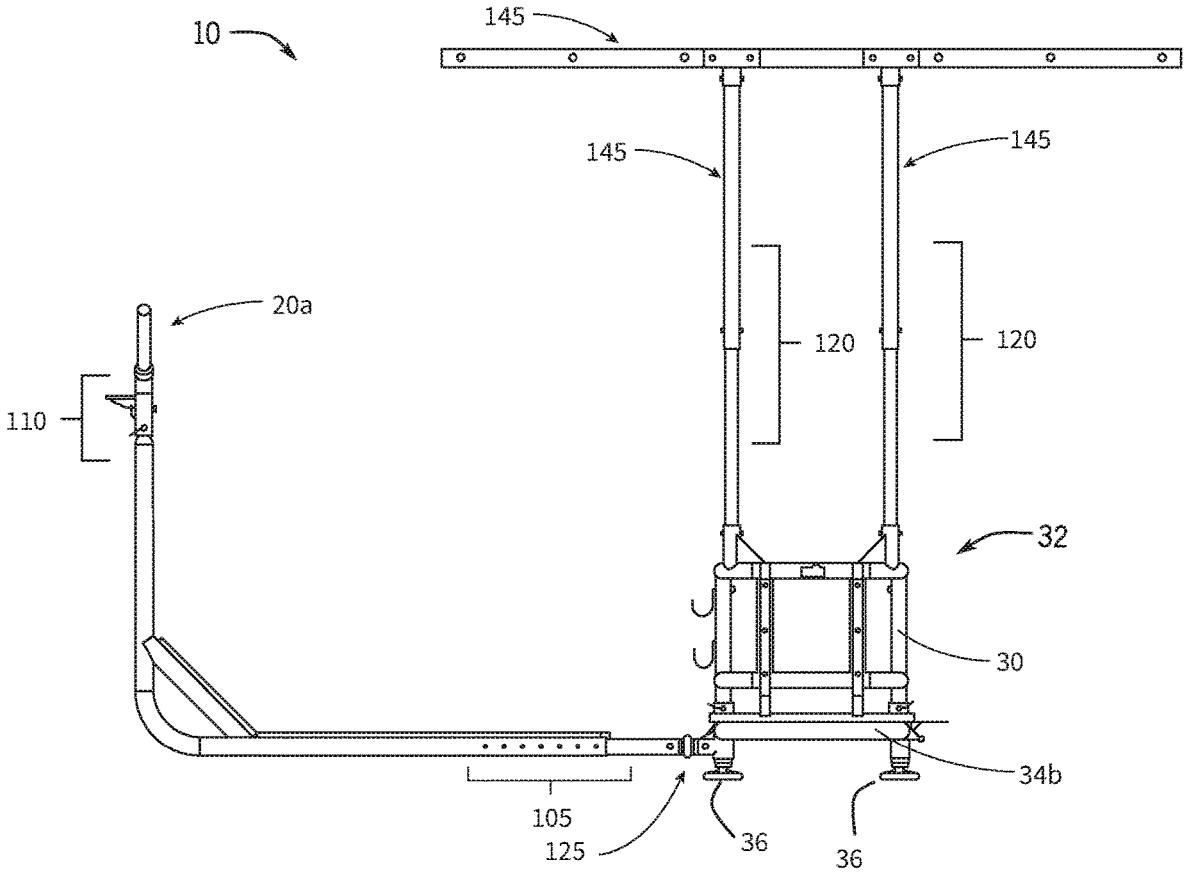
FIG. 14 shows an exemplary left view of one embodiment of the modular watercraft platform.
Figure 15:
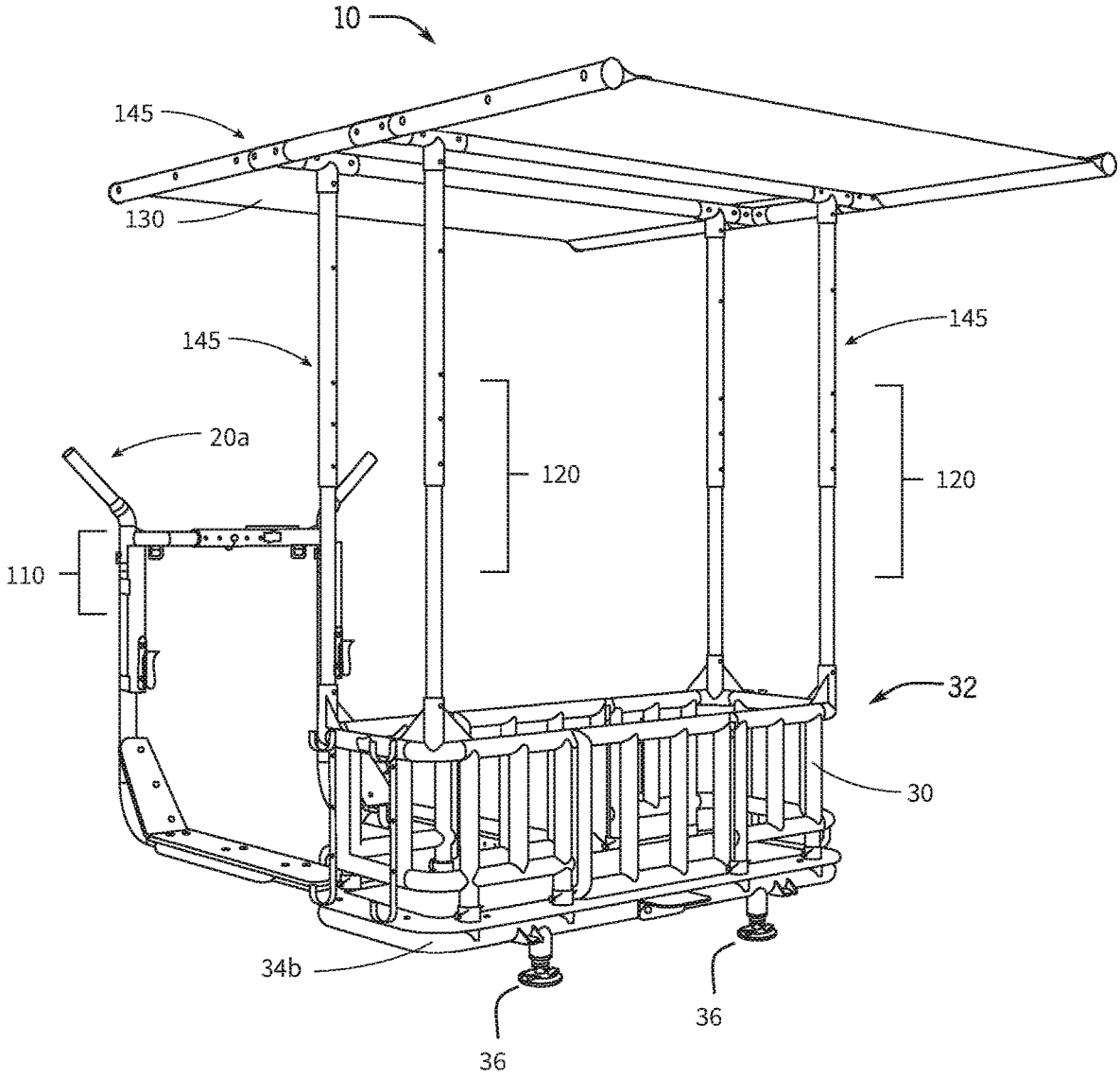
FIG. 15 shows an exemplary perspective view of one embodiment of the modular watercraft platform.
Figure 16:
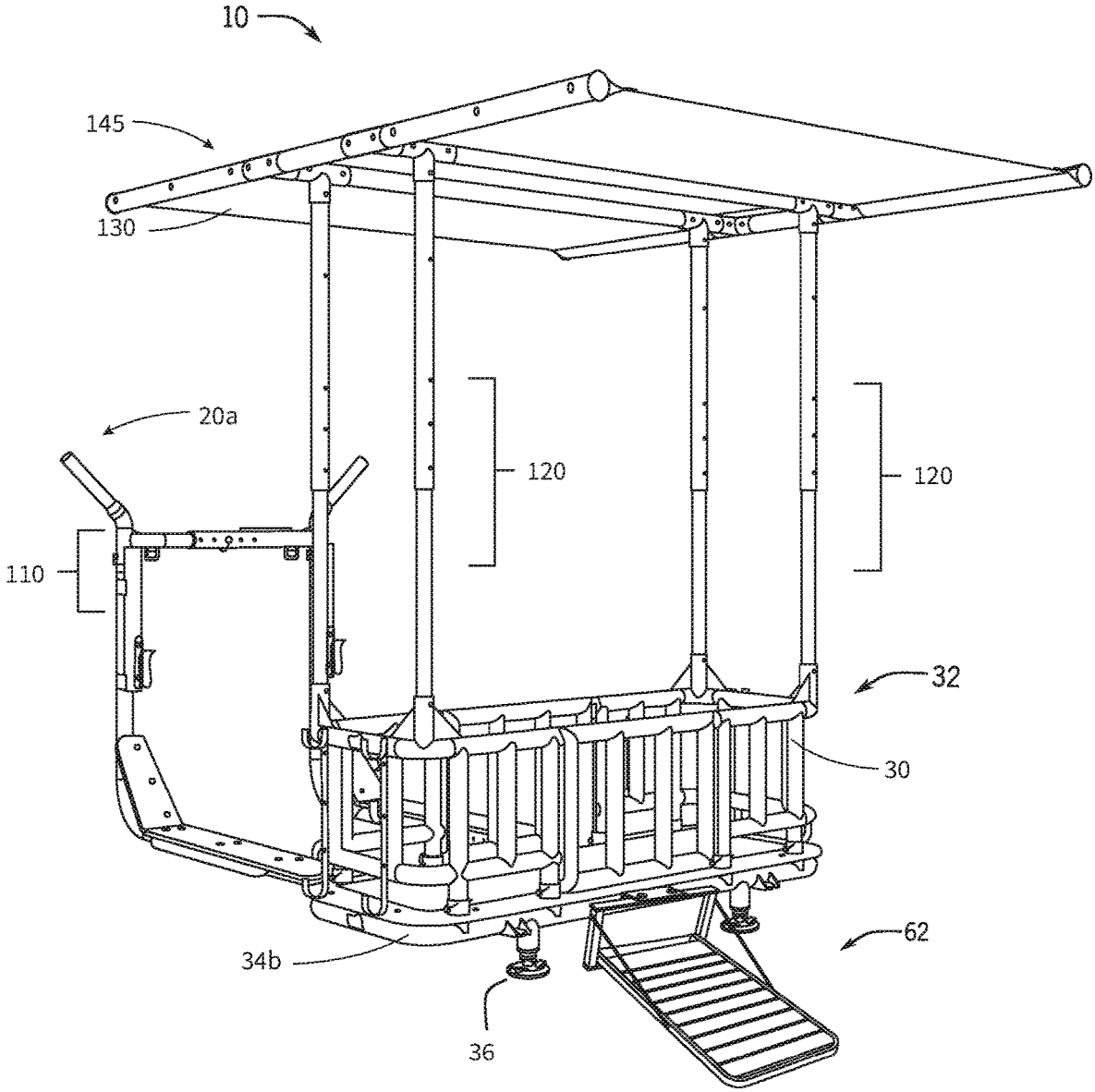
FIG. 16 shows an exemplary perspective view of one embodiment of the modular watercraft platform.

Due to the variable size of different watercraft 12, the canopy 130 may be adjusted to different heights, positions or angles relative to the watercraft 12. A fourth adjustment member 120 having a series of predetermined adjustment stages allows for variable linear adjustment to the position of the canopy 130 and/or the canopy frame 145 relative to the watercraft 12. As shown in FIG. 12, the canopy frame 145 may comprise a pair of the vertical canopy supports adjoined to the rear platform, but other embodiments may comprise at least one vertical canopy support as a portion of the canopy frame 145. As shown in FIG. 14 and FIG. 15, the canopy frame 145 may comprise two pairs of the vertical canopy supports.

The modular watercraft platform 10, in different embodiments, may comprise of at least one material of a materials set consisting of: a metal screen material, a metal mesh material, a metal screen material, a metal material, a foam material, a solid plastic material, a wood material, an electrostatic discharge material, a rubber material, a plastic mesh material, a wood material, a perforated plastic material, a fabric material, a nonporous material, a urethane plastic material, or any combinations thereof. More specifically, the front support assembly 31 and the rear platform assembly 32 may comprise a material that has rust-inhibiting properties such as stainless steel, galvanized materials, or external coatings. In some embodiments, areas coming in direct contact with the object, the human or the animal, such as the left foot deck 16*a*, the rear deck cover 34*c*, the right foot deck 16*a*, the rear deck 34*a*, or any combination thereof, may comprise an external texture. The external texture may comprise at least one member of a texture set consisting of: indentations, extrusions, knurling, a rough surface, and bumps. For example, the left foot deck 16*a* and/or the right foot deck 16*a* may comprise a series of rubber extrusions or rough surfacing to provide the operator of the watercraft 12 stability during normal operation and recreational activities.

Similar to the first adjustment member 105, the second adjustment member 110, the third adjustment member 115, and the fourth adjustment member 120, in some embodiments, the modular watercraft platform 10 may include an articulating joint 125 to adjoin the front support assembly 31 to the rear platform assembly 32. In further detail, the rear platform assembly 32 is movably joined to the front support assembly 31 by the articulating joint 125, wherein the articulating joint 125 is free to translate in any direction to allow elements of the modular watercraft platform 10 substantially match the body of the watercraft 12.

In some embodiments, once the modular watercraft platform 10 has been assembled entirely, the front support assembly 31, or the rear platform assembly 32 have been placed upon the watercraft 12, an attachment member 19 may be adjoined to any component of the modular watercraft platform 10 and/or the watercraft 12. For example, a tie-down strap 38 and a carabiner 40 may be utilized to further secure the modular watercraft platform 10 to the watercraft 12. Other exemplary attachment members include, by way of non-limiting example, a rope, a chain, a ring, a hook, an elastic member, a weight, a pulley, a turnbuckle, a winch, a carabiner 40, and any other securing means known to one skilled in the art. In other embodiments, the rear platform assembly 32 is hingedly joined to the front support assembly 31, wherein the only rotational adjustment along one axis is needed.

The modular watercraft platform 10 may further include any common watercraft accessory or component found on a commercially available watercraft 12, such as a boat. For example, at least one cross-member 20 further may comprise a windshield. The windshield aiding the visibility of the user during normal operation. In another exemplary use, the windshield can be added to reduce water spray and/or rain while the watercraft 12 is under motion.

In a further example, the modular watercraft platform 10 further comprises a backrest 25 joined to the rear platform assembly 32. In other embodiments, the rear platform assembly 32 may further comprise an overhung member 62 adjoined to the rear platform assembly 32. The overhung member 62 can include, by way of non-limiting example, a diving deck, a ramp, a dog crate, steps or a ladder. For example, the overhung member 62 can be configured to allow a hunting dog easier re-boarding access to the watercraft 12. In some embodiments, the at least one barrier 30, the deck frame 34*b*, the at least two frame members, the at least one cross member, any component the modular watercraft platform 10, or any combination thereof may further comprise at least one member of the accessory set. For example, in search and rescue configuration, the rear platform assembly 32 allows for possible additional storage of gas tanks for longer searches, safety flotation devices, or protective clothing. In a further example, for scuba, room may be made on the rear platform assembly 32 for extra oxygen tanks, storage of fins, goggles, spear guns, diving flag mount, ease of access for a diver to re-board the watercraft 12, or to secure a catch bag or a stringer of fish.

In an example involving hunting, the rear platform assembly 32 may be modified to allow a hunting dog to ride in the back, storage of decoys, allow for additional camouflage with or without the canopy 130, a dog crate, or gun storage.

In reference to FIGS. 1 through 16, the present invention may include the following elements:

a modular watercraft platform 10
a watercraft 12
a downrigger 14
a trolling motor 15
a right leg platform 16
a left leg platform 18
an attachment member 19
a cross-member 20
a cup holder 21
a rod holder 20*a*
a right frame member 20*b*
a left frame member 20*c*
a left rod holder 20*d*
a right rod holder 20*e*
a digital processing device mount 22
a backrest 25
a barrier member 30
a front support assembly 31
a rear platform assembly 32
a vertical support 36
a tie down strap 38
a rear deck 34*a*
a deck frame 34*b*
a rear deck cover 34*c*
a left accessory mount 37*a*
a right accessory mount 37*b*
a carabiner 40
an overhung member 62
a first adjustment member 105
a second adjustment member 110
a third adjustment member 115
a fourth adjustment member 120
an articulating joint 125
a canopy 130
a vertical adjustment member 140
a canopy frame 145.

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶16. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A modular watercraft platform for mounting to a watercraft comprising:

a front support assembly comprising:

at least two frame members within a footwell of the watercraft and on each side of a seat of the watercraft, the at least two frame members each having a proximal end and a distal end, wherein the at least two frame members are configured to generally match a body of the watercraft;

at least one cross-member adjoined to the at least two frame members; and, at least two foot decks adjoined to the at least two frame members.

2. The modular watercraft platform of claim 1, further comprising: a rear platform assembly joined to the front support assembly, the rear platform assembly comprising:

a deck frame having a top surface and a bottom surface; and, a rear deck joined to the top surface of the deck frame.

3. The modular watercraft platform of claim 2, further comprising:

at least one barrier member adjoined to and extending from the deck frame, wherein the at least one barrier member assists to retain an object, a human, or an animal upon the watercraft.

4. The modular watercraft platform of claim 2, further comprising:

at least one vertical support adjoined to the bottom surface of the deck frame, wherein the at least one vertical support serves to elevate the rear platform assembly above the body of the watercraft.

5. The modular watercraft platform of claim 1, wherein the distal end of the at least two frame members each further comprise a first adjustment member having a series of predetermined adjustment stages allowing for variable linear adjustment to a length of the distal end.

6. The modular watercraft platform of claim 1, wherein the proximal end of the at least two frame members each further comprise a second adjustment member having a series of predetermined adjustment stages allowing for variable linear adjustment to a length of the proximal end.

7. The modular watercraft platform of claim 1, wherein the proximal end of the at least two frame members is angled.

8. The modular watercraft platform of claim 1, wherein the at least one cross-member further comprises a third adjustment member having a series of predetermined adjustment stages allowing for variable linear adjustment to a length of the at least one cross-member.

9. The modular watercraft platform of claim 3, further comprising:

a canopy having a canopy frame joined to and extending above the rear platform assembly.

10. The modular watercraft platform of claim 9, wherein the canopy frame further comprises a fourth adjustment member having a series of predetermined adjustment stages allowing for variable linear adjustment to a position of the canopy relative to the deck frame.

11. The modular watercraft platform of claim 3, wherein the rear deck, the at least one barrier member, the deck frame, the at least two frame members, the at least one cross-member, or any combination thereof further comprises at least one member of an accessory set consisting of: a downrigger mount, a cup holder, a fishing rod mount, a cushion, a hook, a gas tank mount, an air tank mount, a floatation device mount, an anchor mount, a cooler mount, a foldable cooler mount, a live well mount, a battery mount, a clip, a detachable seat, a table, a trolling motor mount, an outboard mount, a shallow water anchor mount, a camera mount, a grill mount, a flag mount, a navigation light, a digital processing device mount, a gun mount, a fish-finder mount, a radar mount, a sonar mount, and a chart plotter mount.

12. The modular watercraft platform of claim 2, wherein the at least two foot decks, the rear platform assembly, or any combination thereof further comprise an external texture.

13. The modular watercraft platform of claim 12, wherein the external texture further comprises at least one member of a texture set consisting of: indentations, extrusions, knurling, a rough surface, and bumps.

14. The modular watercraft platform of claim 2, wherein the rear platform assembly is moveably joined to the front support assembly by an articulating joint, wherein the articulating joint is free to translate in any direction.

15. The modular watercraft platform of claim 2, wherein the rear platform assembly is pivotally joined to the front support assembly.

16. The modular watercraft platform of claim 1, wherein the at least one cross-member further comprises a windshield.

17. The modular watercraft platform of claim 2, wherein the modular watercraft platform further comprises a backrest to the rear platform assembly.

18. The modular watercraft platform of claim 2, wherein the rear platform assembly further comprises an overhung member adjoined to the rear platform assembly.

* * * * *